US008464731B1

(12) United States Patent
Eberlein et al.

(10) Patent No.: US 8,464,731 B1
(45) Date of Patent: Jun. 18, 2013

(54) COSMETIC COMPACT WITH TWISTABLE LID

(75) Inventors: David Jeffrey Eberlein, Los Angeles, CA (US); Megan Rene Langdon, Los Angeles, CA (US)

(73) Assignee: HCT Asia Ltd, Central (HK)

( * ) Notice: Subject to any disclaimer, the term of this patent is extended or adjusted under 35 U.S.C. 154(b) by 0 days.

(21) Appl. No.: 13/366,102

(22) Filed: Feb. 3, 2012

(51) Int. Cl.
*A45D 42/02* (2006.01)

(52) U.S. Cl.
USPC ..... 132/301

(58) Field of Classification Search
USPC ..... 132/287, 294, 300, 314, 315; 206/823, 206/581, 235, 457
See application file for complete search history.

(56) References Cited

U.S. PATENT DOCUMENTS

| | | | | |
|---|---|---|---|---|
| 5,348,031 | A * | 9/1994 | Cloud | 132/317 |
| 6,070,749 | A * | 6/2000 | Joulia | 220/4.22 |
| 6,712,076 | B2 * | 3/2004 | Alexander et al. | 132/300 |
| 2007/0080094 | A1 * | 4/2007 | Moon | 206/581 |

* cited by examiner

*Primary Examiner* — Todd Manahan
*Assistant Examiner* — Brianne Kalach
(74) *Attorney, Agent, or Firm* — Lee & Hayes, PLLC

(57) ABSTRACT

A cosmetic compact includes a twistable lid assembly that spins relative to a base assembly about a hinge to change between an open and a closed position. The hinge is disposed in the cosmetic compact at an oblique angle that positions a top surface of the cosmetic compact to face a user after twisting open. The lid assembly is twistable by about 180 degrees relative to the base assembly of the cosmetic compact. By virtue of having the twistable lid assembly, the cosmetic compact is capable of simple and reliable opening. The twistable lid assembly also allows a mirror placed on the top surface of the compact to be useful in both a closed position and an open position.

20 Claims, 9 Drawing Sheets

COSMETIC COMPACT WITH TWISTABLE LID

BACKGROUND

Vessels exist for portable transport of cosmetic or medicinal products. Typically, existing vessels consist of a base and a lid that, when assembled together, open and close to access a product stored in a pan. Most existing vessels employ a clamshell design in which the lid folds away from the base to open and the lid folds onto the base to close. The existing vessels also usually contain a mirror on the bottom of the lid to aid in applying the product when the vessel is open. When the existing vessels are closed, the mirror is housed inside the vessel. However, the existing vessels have limited functionality due to the mirror only being available while in an open state, and because folding the lid onto or away from the base may be cumbersome and difficult for some users. In addition, the clamshell design might also be weaker and more susceptible to breakage.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
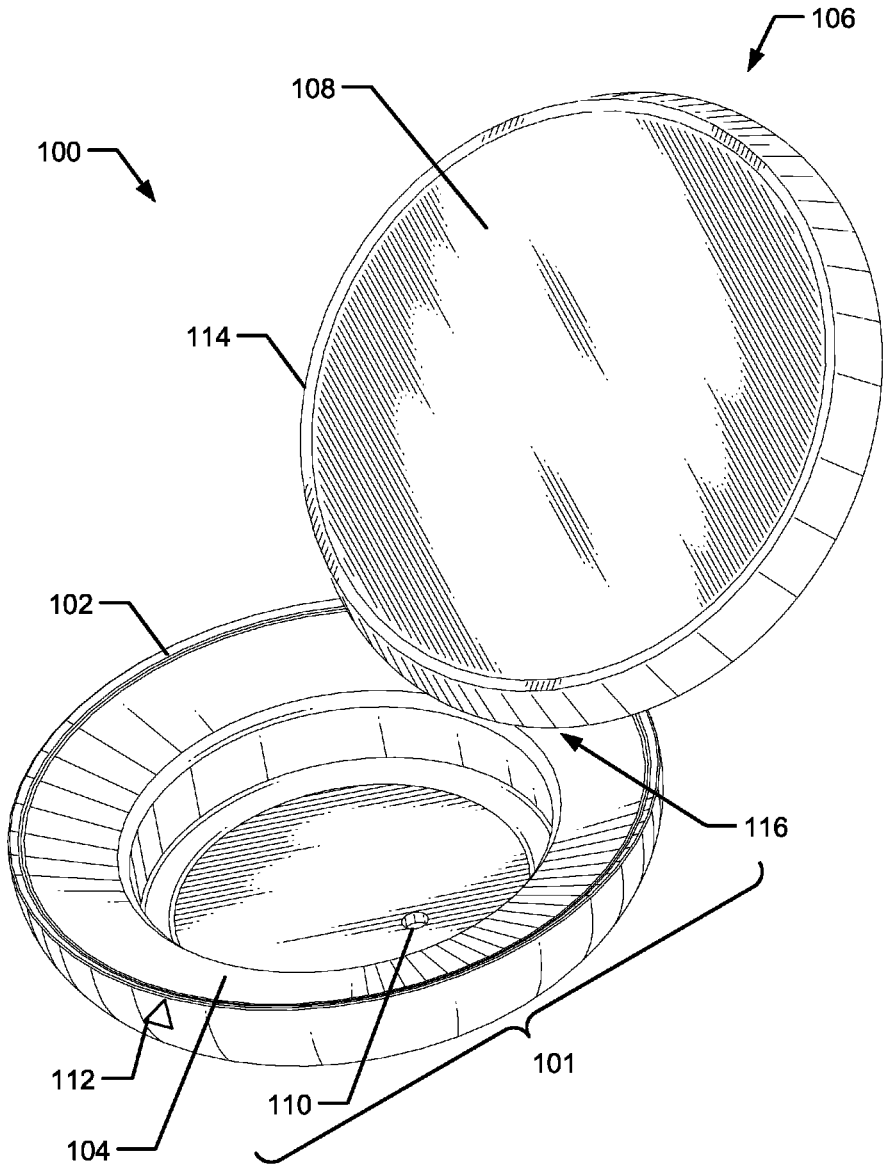
FIG. 1 depicts a perspective view of an example cosmetic compact with a twistable lid assembly in an open position.

Typically, existing cosmetic compacts consist of a base and a lid that when assembled together open and close to access a product stored in the base. Currently available cosmetic compacts usually include a clamshell design for opening or closing the lid relative to the base. For example, the lid and the base fold away from or onto each other to open and close, respectively. In addition to incorporating a clamshell design to open and close, existing compacts also usually include a mirror on the inside of the lid, such that the mirror is only visible, and thus useful, when the compact is in an open state. Alternatively, in the event that the mirror is included on an external surface of the lid, opening the compact via a clamshell design renders the mirror useless as it no longer faces a user when in the open state. Thus, using existing compacts, the mirror is designed to be useful in either an open state or a closed state, but not both. Furthermore, due to the clamshell design, existing compacts may be cumbersome to open and close for some users and may be more susceptible to breakage, regardless of whether or not the compact includes a mirror.

This application describes an example compact that includes a lid assembly that twists or spins about a hinge to open and close. By virtue of having a twistable lid assembly, the compact can open and close with improved ergonomics over currently available compacts. In addition, the twistable lid assembly enables a mirror on an external surface of the lid assembly to be useful to a user in both a closed position and an open position. Whether or not the example compact includes a mirror, or a pan for product, the hinge allows the lid assembly to twist in order to change between the open position and the closed position.

Generally, a compact according to this disclosure includes a base assembly, a twistable lid assembly, and a hinge that allows the twistable lid assembly to twist relative to the base assembly. The base assembly may include a base and an insert, which may be separate elements or may be formed integrally as a single component. The twistable lid assembly may include a lid, a mirror, and a hinge, which may be separate elements or may be formed integrally as a single component. The hinge is disposed in the base assembly at an oblique angle relative to a bottom surface of the base. In other words, the hinge is disposed in the base assembly at an angle that is neither parallel nor perpendicular to a bottom surface of the base assembly. In some embodiments, the hinge is disposed at an oblique angle in the perimeter of the twistable lid assembly. Alternatively, the hinge may be disposed at an oblique angle in the perimeter of the insert. In addition to the hinge, some embodiments of the compact include a pan for holding product. Additionally or alternatively, the compact may include a mirror on an exterior surface of the twistable lid assembly for use while the twistable lid assembly is in a closed position. With the hinge orientated at an oblique angle, the twistable lid assembly moves up and away from the base assembly during opening resulting in the mirror (when included) facing a user in a convenient angle when the twistable lid assembly is in an open position. In another embodiment, the compact may further include a retention mechanism to maintain the twistable lid assembly in the open or the closed position relative to the base assembly.

For some examples given below, the compact is described in the context of storing a cosmetic powder product in a pan located in a cavity of the base assembly. In such an example, the pan may be a separate element housed in the cavity in the base assembly or may be formed integrally with the base assembly. However, compacts as described herein may be used and adapted to store other cosmetic products (e.g. lipstick, chap stick, lip gloss, lotions, creams, gels, rouges, blushes, foundation, etc.), may store products other than cosmetics, or may omit storing a product entirely.

Illustrative Compact with Twistable Lid

FIG. 1 depicts a perspective view of an example cosmetic compact 100 with a twistable lid assembly in an open position. The example cosmetic compact 100 includes a base assembly 101 including a base 102 and an insert 104, a twistable lid assembly 106, a mirror 108, an opening 110, and a mark 112. In the illustrative example, the twistable lid assembly 106 includes the mirror 108, a lid 114, and a hinge 116 disposed in the perimeter. In another example, the twistable lid assembly 106 may include the lid 114. In another embodiment, the hinge 116 may be disposed in a perimeter of the base assembly 101 (e.g., in the base 102 and/or the insert 104). The base assembly 101 is pivotably attached, via the hinge 116, to the twistable lid assembly 106. While the base assembly 101 and the twistable lid assembly 106 are illustrated as having a substantially circular shape when viewed from above, a variety of other shapes and types are contemplated. For example, when viewed from above the shape of the base assembly 101 and the twistable lid assembly 106 may be generally rectangular, square, ovoid, elliptical, or any other suitable shape.

The base assembly 101 and the twistable lid assembly 106 may be constructed of any suitable material which, by way of example and not limitation, may include plastic, metal, wood, ceramic, glass, fiberglass, carbon fiber, or a composite of any of the forgoing. In some specific examples, suitable materials may include thermoplastic elastomers (TPE), polyethylene (PE), polypropylene (PP), polyethylene terephthalate (PET), acrylonitrile butadiene styrene (ABS), polyvinyl chloride (PVC), steel, chrome, stainless steel, aluminum, nickel, copper, bronze, titanium, gold, platinum, silver, and/or Zamac. Different components may be made of different materials (e.g., base assembly 101 made of one material, while twistable lid assembly 106 made of another material). Moreover, components may be made of more than one material (e.g., base assembly 101 or twistable lid assembly 106 may have a plastic core covered in metal or a metal core surrounded in plastic).

In the embodiment shown in FIG. 1, the insert 104 may be at least partially encased by the base assembly 101. Insert 104 may comprise a fastening mechanism for fastening the insert 104 to the base 102. For example, one or more fastening protrusions arranged along the perimeter of the insert 104 may be configured to be received by one or more pockets in the perimeter of the base 102. Alternatively, the one or more fastening protrusions may be arranged along the perimeter of the base 102 while the one or more pockets may be arranged along the perimeter of the insert 104. In other examples, the fastening mechanism may include a threading mechanism, a bayonet fastening mechanism, a press fit mechanism, adhesion mechanism, combinations of the foregoing, or the like. While insert 104 is shown here to have a substantially circular shape, other insert shapes such as generally rectangular, square, elliptical, or the like, may alternatively be used. For example, the shape of the insert 104 may be square while the base 102 that partially encases the insert 104 may be circular or vice versa. In addition, some examples of the insert 104 may include two or more compartments for storing one or more products.

In some embodiments, a pan (not shown) partially encased by the insert 104 may contain cosmetic products such as powder-based cosmetic products. In some examples, the pan may include other cosmetic products such as lipstick, chap stick, lip gloss, lotions, creams, gels, rouges, blushes, or foundation. Further, a cavity inside the base assembly 101 may contain an applicator (e.g., a puff, a brush, a sponge, a flocked sponge, or the like). In other embodiments, the cavity inside the base assembly 101 may contain a volatile product such as an alcohol or a water based product, in which case the example cosmetic compact 100 may further include an airtight seal to prevent evaporation. In still other embodiments, the cavity inside the base assembly 101 may contain a product or item other than a cosmetic (e.g., wax, paint, etc.).

In the illustrated example, the example cosmetic compact 100 also includes the mirror 108 on a top surface of the twistable lid assembly 106. In a used position (e.g., an open position) the top surface of the twistable lid assembly 106 faces a user that may be accessing, for example, the pan inside the cavity of the base assembly 101.

As illustrated in FIG. 1, the example cosmetic compact 100 also includes the opening 110. In this example, the opening 110 comprises a diameter about 2 millimeters and provides for removal of the pan. For example, the pan may be removed by inserting an implement into the opening 110 such that a force applied by the implement on the pan causes the pan to move. In one embodiment, the opening 110 may be an unobstructed or unoccupied space, such as a hole. In other embodiments the opening 110 may be occupied by a material, such as rubber, while still enabling an implement to remove the pan by making contact with the material, which in turn applies a force on the pan causing it to move. In this embodiment, the material occupying the opening 110 may serve to help prevent a product inside the compact from exiting through the opening 110. While the opening 110 is shown as comprising a substantially circular shape, other sizes and/or shapes may also be used. For example, the shape of the opening 110 may be generally circular, rectangular, triangular, elliptical, combinations of the foregoing, or the like. In some examples, the location of the opening 110 may be on any surface of the base assembly 101 and may further vary in size to accommodate a variety of implements used to remove the pan.

FIG. 1 further illustrates the mark 112 disposed on the base assembly 101 which indicates the front of the cosmetic compact 100. Additionally or alternatively, the mark 112 may be disposed (e.g., painted, embossed, molded, etched, etc.) on an outer surface of the twistable lid assembly 106. While the mark 112 illustrated in FIG. 1 is a triangle, any mark may be used, such as a dot, a line, a letter, a figure, a shape, an arrow, or the like.

The hinge 116 enables the twistable lid assembly 106 to twist relative to the base assembly 101. In this embodiment, the open position is described as being achieved when a sufficient amount of rotational force is applied by a user to the twistable lid assembly 106 relative to the base assembly 101. Spinning the twistable lid assembly 106 about the hinge 116 to the open position enables a user to access product in the pan and/or utilize the mirror 108 disposed on the top surface of the twistable lid assembly 106. While the twistable lid assembly 106 is shown here to be twistable about the hinge 116, other rotational mechanisms, such as substituting the hinge 116 with a ball and socket molded into the base assembly 101 and/or the twistable lid assembly 106 are also possible. In another embodiment, the hinge 116 may be configured to allow the twistable lid assembly 106 to spring open automatically once a sufficient amount of rotational force is applied by the user to the twistable lid assembly 106 relative to the base assembly 101. Operation of the hinge 116 is detailed below in FIG. 4.

Figure 2:
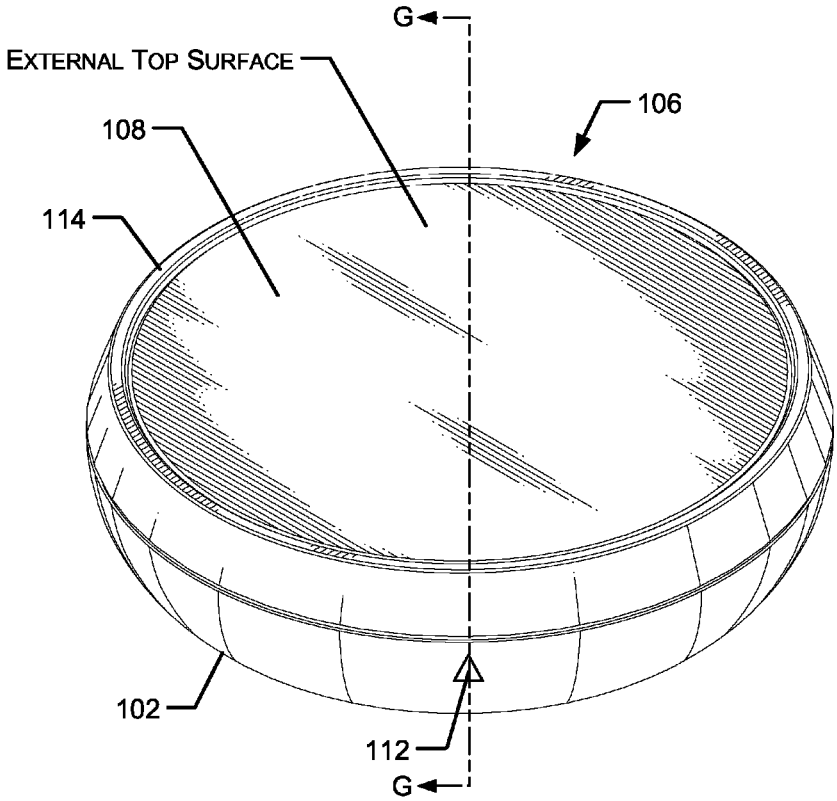
FIG. 2 is a perspective view of the example cosmetic compact of FIG. 1 in a closed position.

FIG. 2 is a perspective view of the example cosmetic compact 100 of FIG. 1 in a closed position. As illustrated in FIG. 2, the example cosmetic compact 100 is closed when an external top surface of the twistable lid assembly 106 is substantially parallel to a bottom surface of the base assembly 101. In the illustrated example, the mirror 108 disposed on the external top surface of the twistable lid assembly 106 is available for use in the closed position (e.g., a stowed position). In some embodiments, the external top surface may be planar, though other surface shapes are also contemplated. For instance, the surface shape of the external top surface may be concave, convex, combinations of the foregoing, or the like.

Figure 3:
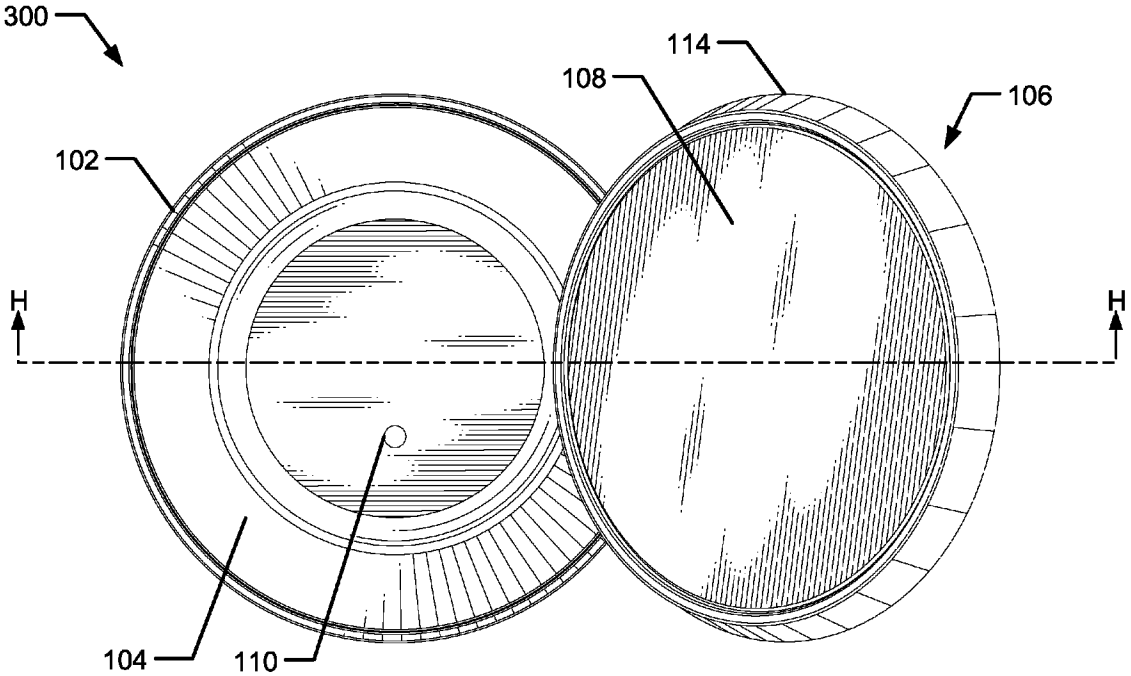
FIG. 3 is a top view of the example cosmetic compact of FIG. 1.

FIG. 3 is a top view 300 of the example cosmetic compact 100 of FIG. 1.

Figure 4:
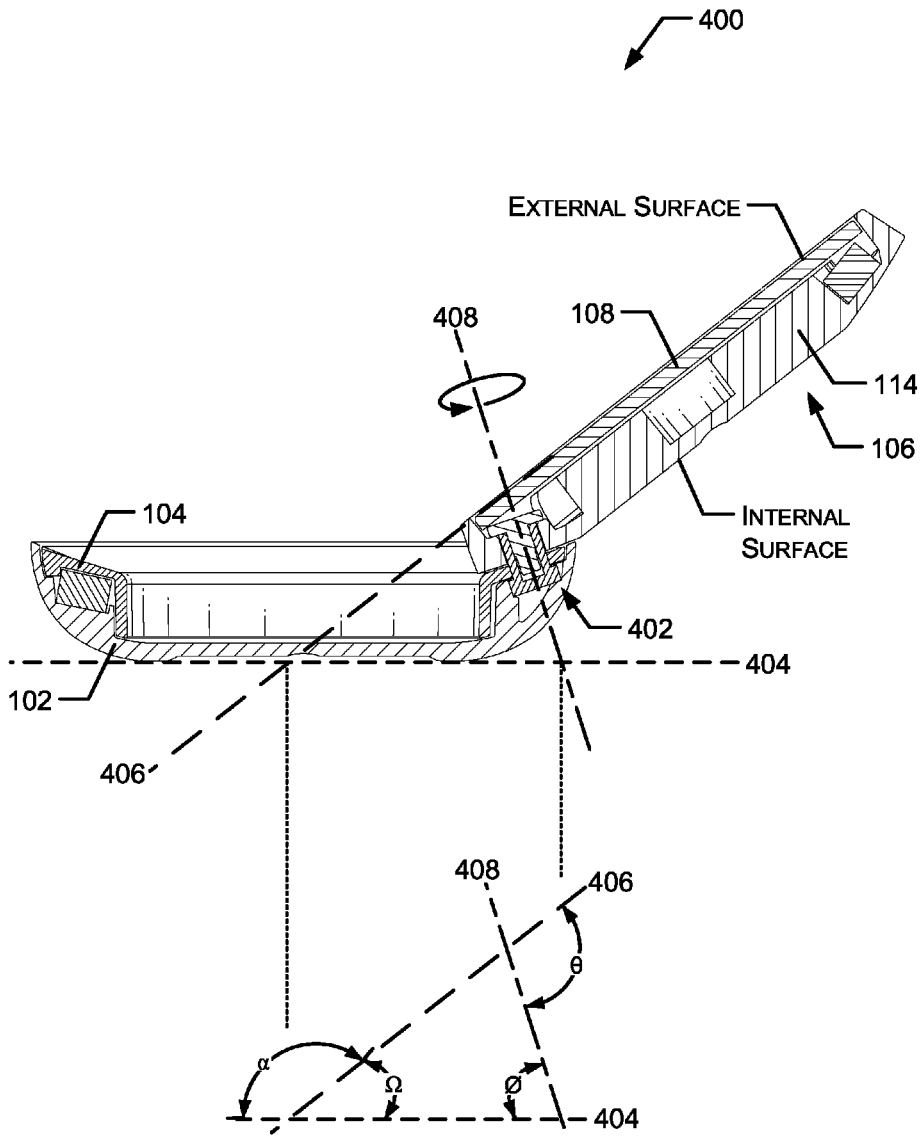
FIG. 4 is cross-sectional view of the example cosmetic compact of FIG. 1 taken along line H-H in FIG. 3, showing an example rotational mechanism for twisting the twistable lid assembly relative to a base assembly.

FIG. 4 is cross-sectional view 400, taken along line H-H in FIG. 3, of the example cosmetic compact 100 of FIG. 1 showing an example rotational mechanism 402 for twisting the twistable lid assembly 106 relative to the base assembly 101. In the illustrated example in FIG. 4, the example rotational mechanism 402 comprises the hinge 116. In this particular example, the hinge 116 includes a barrel hinge. However, in other embodiments, the hinge 116 may be replaced with a ball and socket molded into the base assembly 101 and/or the twistable lid assembly 106. Contact surfaces within the hinge 116 provide a large supporting surface making the hinge 116 very strong, stable, and durable.

FIG. 4 also depicts the twistable lid assembly 106 having an external surface and an internal surface. The hinge 116 enables the twistable lid assembly 106 to spin relative to the base assembly 101. In one embodiment, the hinge 116 may be disposed in the perimeter of the base assembly 101 at an oblique angle Ø relative to a bottom surface of the base assembly 101 (e.g., axis 404). For example, angle Ø may be between about 45 and 80 degrees. In another embodiment, the hinge 116 may alternatively be disposed on an outer perimeter of the twistable lid assembly 106 at an oblique angle θ relative to the external surface (e.g., axis 406) of the twistable lid assembly 106. For example, angle θ may be between about 100 and 170 degrees. Twistable lid assembly 106 is spinnable about a central axis 408 that is defined by a radial center of the hinge 116. Twistable lid assembly 106 is swivelible in a counter clock-wise direction, a clock-wise direction, or both, about the central axis 408 by about 180 degrees. The external surface of the twistable lid assembly 106 changes by angle Ω relative to the bottom surface of the base assembly 101 when changing from a closed position to an open position or when changing from the open position to the closed position. In one embodiment, the angle Ω is about 75 degrees. In another embodiment, the angle Ω is about 45 degrees.

As illustrated in FIG. 4, the hinge 116 links the base assembly 101 and the twistable lid assembly 106 and enables the twistable lid assembly 106 to pivot by at least about 180 degrees relative to the base assembly 101. In some examples, the hinge 116 enables the twistable lid assembly 106 to be continuously rotatable relative to the base assembly 101. In one embodiment, an angle at which the hinge is disposed in the base assembly 101 (e.g., oblique angle Ø) allows the twistable lid assembly 106 to remain open at a predetermined angle α relative to the base assembly 101. In some examples, the predetermined angle α may be between 90 degrees and 180 degrees. In another example, the predetermined angle α may be about 120 degrees.

Figure 5:
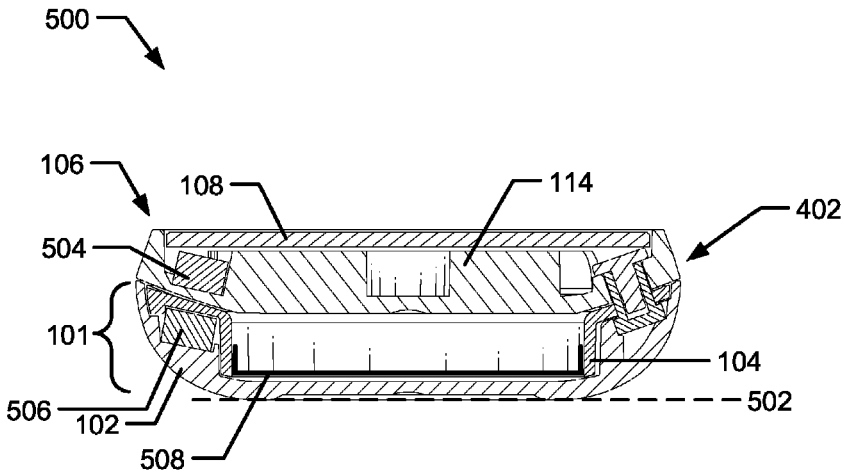
FIG. 5 is a cross sectional view of the example cosmetic compact of FIG. 1 in the closed position, taken along line G-G of FIG. 2.

FIG. 5 is a cross sectional view 500, taken along line G-G in FIG. 2, of the example cosmetic compact 100 of FIG. 1 in a closed position. FIG. 5 illustrates an axis 502 substantially parallel to the bottom surface of the base assembly 101 such that the example cosmetic compact 100 is in the closed position when a top surface of the twistable lid assembly 106 is substantially parallel to axis 502. In one embodiment, FIG. 5 further illustrates a closure mechanism to retain the twistable lid assembly 106 in a closed position relative to the base assembly 101. In the illustrated example, the closure mechanism includes a first magnet 504 disposed in the twistable lid assembly 106 and a second magnet 506 disposed in the base assembly 101. The first magnet 504 and the second magnet 506 are attracted to each another, and together, provide a magnetic force to maintain the twistable lid assembly 106 in the closed position. The twistable lid assembly 106 may be twisted relative to the base assembly 101 by applying sufficient force to overcome the magnetic force attracting the first magnet 504 to the second magnet 506. In another embodiment, the second magnet 506 may be disposed in the insert 104 or the base 102, while still enabling attraction to the first magnet 504. The first magnet 504 may take the same or similar shape as the second magnet 506 or may be configured differently than the second magnet 506. However, in another embodiment, the first magnet 504 and the second magnet 506 may not be included in the example cosmetic compact 100. Alternatively, the closure mechanism may include substituting the first magnet 504 or the second magnet 506 for a ferrous, or other magnetic material. In yet another embodiment, the closure mechanism may include a snap fit, an interference fit, a friction mechanism, or the like, in place of the first magnet 504 and/or the second magnet 506.

FIG. 5 further illustrates a pan 508 for storing a product. In this example, the base 102 and the insert 104 partially encases the pan 508. As illustrated, the base assembly 101 includes the base 102, the insert 104, and the pan 508. The product may include a cosmetic powder, or other cosmetic product. Pan 508 may be constructed of any suitable material which, by way of example and not limitation, may include plastic, metal, wood, ceramic, glass, fiberglass, carbon fiber, or a composite of any of the forgoing. The pan 508 may vary in size and shape. For example, the walls of the pan 508 may extend higher or lower relative to the insert 104. Additionally, the wall thickness of the pan 508 may vary from the illustrated example.

Figure 6:
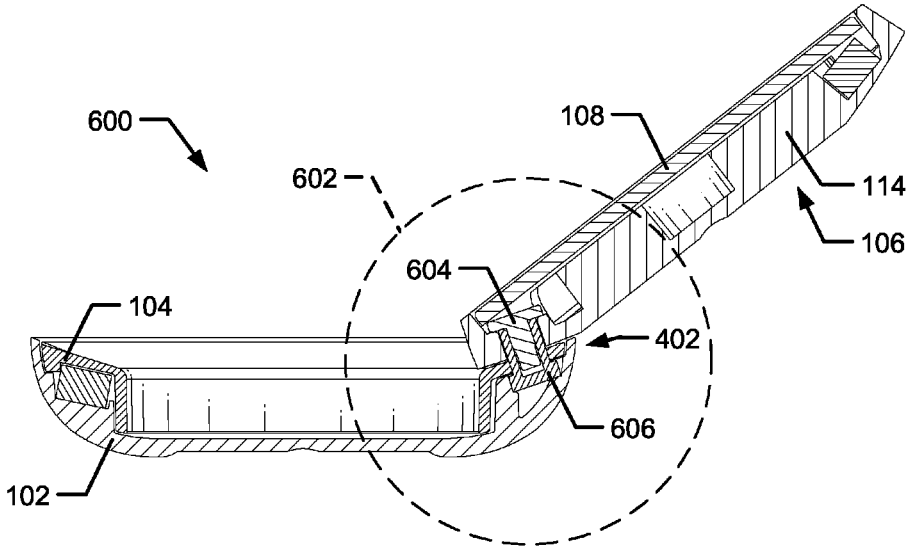
FIG. 6 is a cross-sectional view of the example cosmetic compact of FIG. 1 and includes a close-up area surrounding the example rotational mechanism of FIG. 4.

FIG. 6 is a cross-sectional view 600 of the example cosmetic compact 100 of FIG. 1 and includes a close-up area 602 surrounding the example rotational mechanism 402 of FIG. 4. As illustrated in FIG. 6, the example rotational mechanism 402 includes a drive 604 disposed in the perimeter of the twistable lid assembly 106 and a barrel 606 disposed in the perimeter of the base assembly. The drive 604 and the barrel 606 are configured to interact with each another to enable the twistable lid assembly 106 to spin open and closed relative to the base assembly 101. A surface on the drive 604 makes contact with a complementary surface on the barrel 606 providing strength, durability, and stability to the example rotational mechanism 402. In another embodiment, the drive 604 may be disposed in the perimeter of the base assembly 101 and the barrel 606 may be disposed in the perimeter of the twistable lid assembly 106. The drive 604 and the barrel 606 may be constructed of any suitable material which, by way of example and not limitation, may include plastic, metal, wood, ceramic, glass, fiberglass, carbon fiber, or a composite of any of the forgoing. In some specific examples, suitable materials may include thermoplastic elastomers (TPE), polyethylene (PE), polypropylene (PP), polyethylene terephthalate (PET), acrylonitrile butadiene styrene (ABS), polyvinyl chloride (PVC), steel, chrome, stainless steel, aluminum, nickel, copper, bronze, titanium, gold, platinum, silver, and/or Zamac.

Figure 7A:
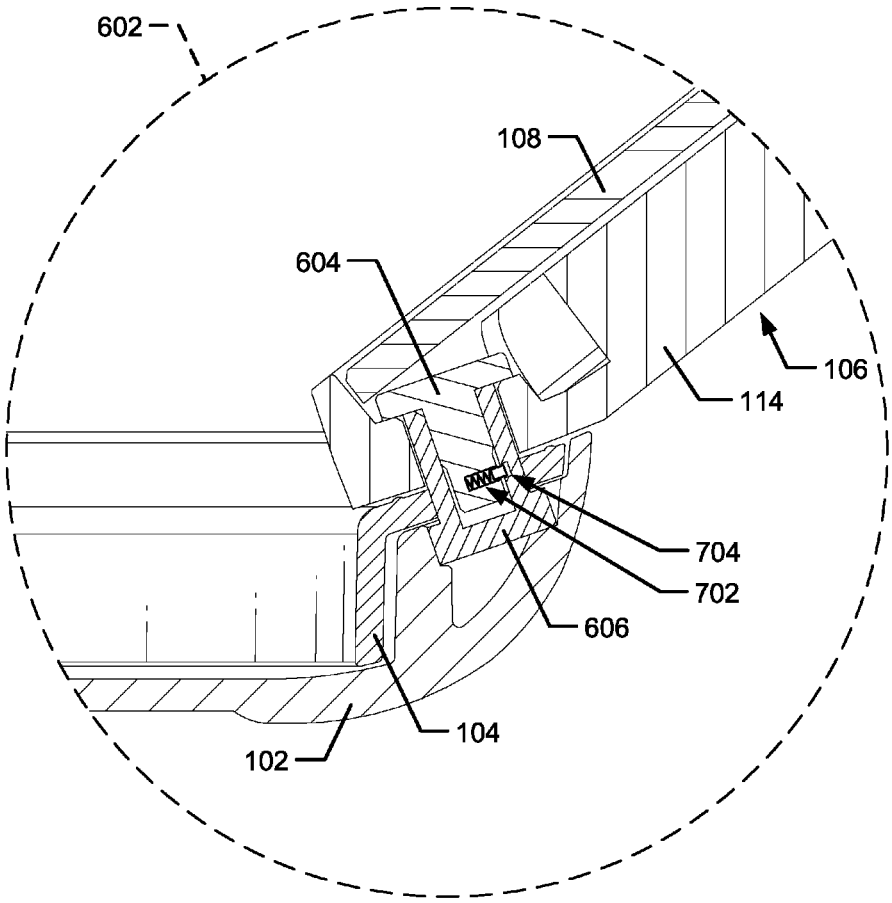
FIGS. 7A-7C are cross-sectional views illustrating example retention mechanisms to maintain the twistable lid assembly in the open position and/or the closed position relative to the base assembly.
Figure 7B:
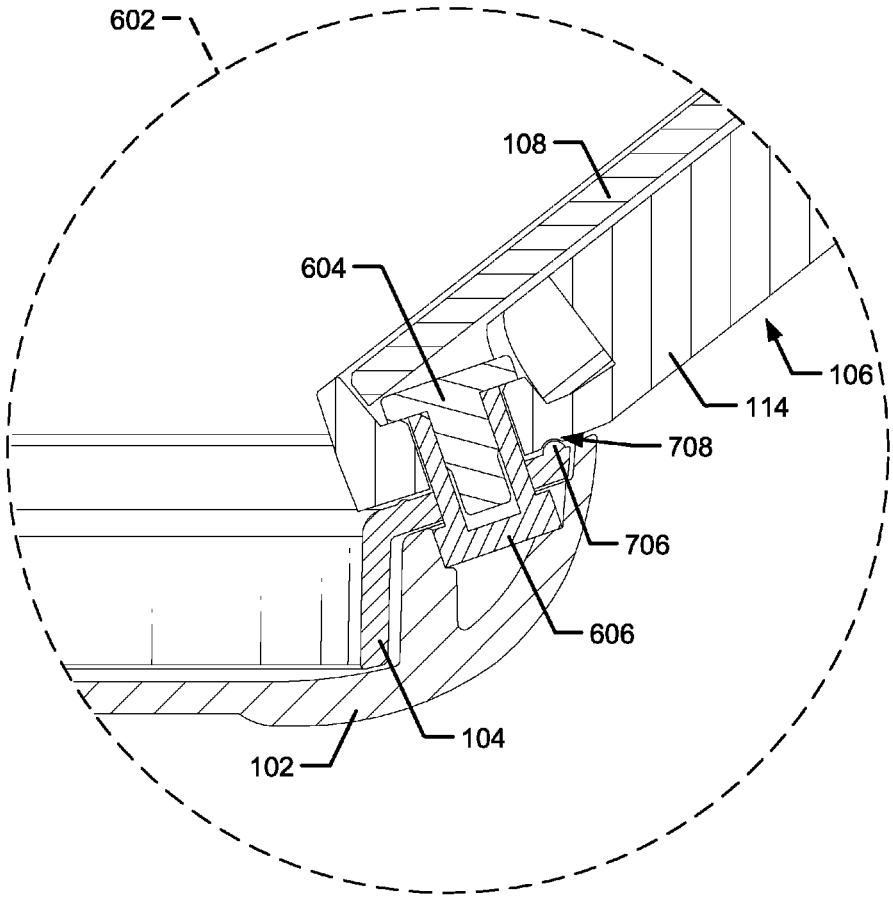
Figure 7C:
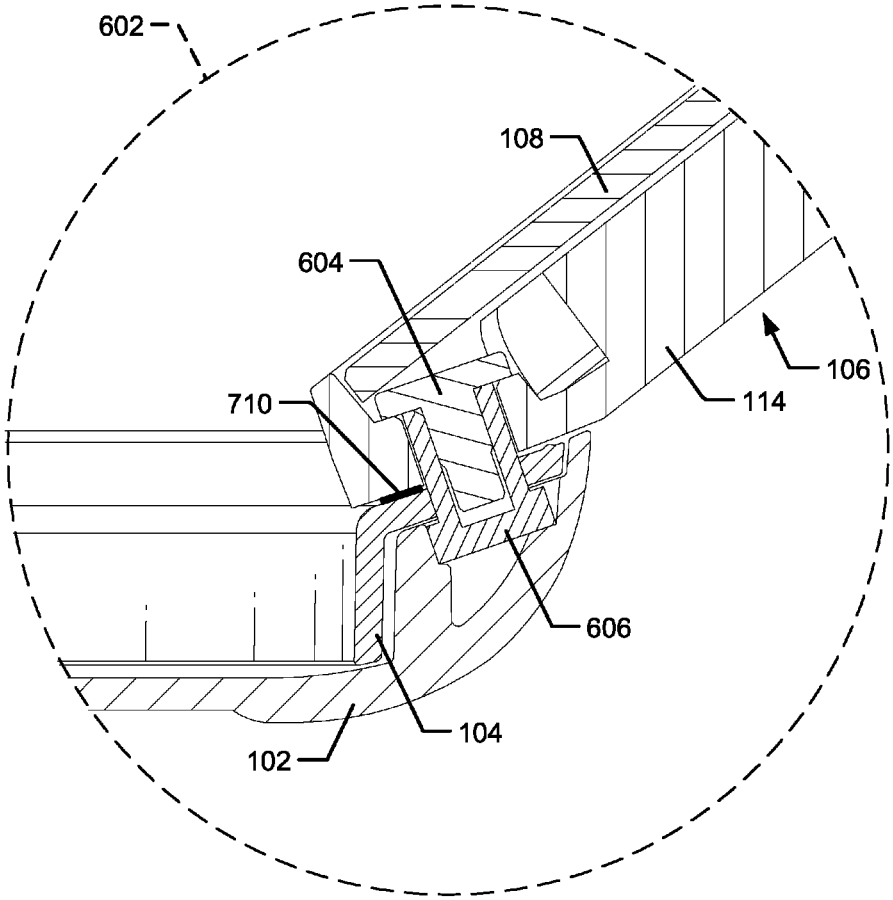

FIGS. 7A-7C are cross sectional views illustrating example retention mechanisms to maintain the twistable lid assembly 106 in the open position and/or the closed position relative to the base assembly 101. Each of the retention mechanisms in FIGS. 7A-7C are configured to i) allow the twistable lid assembly 106 to twist relative to the base assembly 101 in response to application of a force at or above an adjusting threshold, and ii) maintain position of the twistable lid assembly 106 relative to the base assembly 101 when a force applied to the twistable lid assembly 106 is below the adjusting threshold. The adjusting threshold is chosen to be a force sufficient to overcome a frictional force between the twistable lid assembly 106 and the base assembly 101. In some examples, the retention mechanism may include a magnetic retention mechanism in which, for example, a magnet is disposed in the twistable lid assembly 106 and a complimentary magnet is disposed in the base assembly 101. Alternatively, the magnet or the complimentary magnet may be substituted for a ferrous, or other magnetic material. Additionally or alternatively, the retention mechanism may include an interference fit between the twistable lid assembly 106 and the base assembly 101. In another example, the retention mechanism may include a spring loaded detent or a spring loaded pin disposed in the twistable lid assembly 106 or the base assembly 101. In still another example, one or more shapes on the twistable lid assembly 106 may be configured to engage with one or more complimentary shapes in the base assembly 101. The twistable lid assembly 106 may be retained in the open and/or the closed positions relative to the base assembly 101 by a variety of retention means, such as by snap fit, by magnetic force, by interference fit, combinations of any of the foregoing, or the like.

In FIG. 7A, the hinge 116 may retain the twistable lid assembly 106 in the open position relative to the base assembly 101 through rotational friction achieved when a spring loaded pin 702 disposed in the drive 604 is dimensioned to form a friction fit with opening 704 disposed on the barrel 606. In the illustrated example, the shape of the spring loaded pin 702 and the opening 704 are shown to be substantially rectangular, however, in other examples, the shape of the spring loaded pin 702 and the opening 704 may be generally circular, ovoid, square, or the like. Additionally or alternatively, a detent mechanism may be included on the drive 604, the barrel 606, the twistable lid assembly 106, and/or the insert 104 to maintain the open position and/or the closed position. By way of example and not limitation, the detent mechanism may include a spring loaded ball, a spring loaded pin, or the like, which is designed to mate with a complimentary detent.

In FIG. 7B, rotational friction may be achieved when one or more shapes 706 on the base assembly 101 are mated with one or more complimentary shapes 708 on the twistable lid assembly 106 to form a friction fit. While the one or more shapes 706 are shown on one surface of base assembly, the one or more shapes 706 may be on more than one surface, with additional complimentary shapes on twistable lid assembly 106 as needed to create an interference fit. The one or more shapes 706 on the base assembly, and the one or more complimentary shapes 708 on the twistable lid assembly 106 may include a rib, a dimple, a recess, an opening, a ridge, an indent, a protrusion, combination of the foregoing, or the like.

In FIG. 7C, rotational friction is achieved when a frictional material 710, disposed on the periphery of the base assembly and/or the twistable lid assembly 106, has frictional characteristics greater than that of the base assembly or twistable lid assembly 106. The surface of the frictional material 710 creates a restraining force that resists rotation of the twistable lid assembly 106 relative to the base assembly. By having frictional characteristics greater than that of the twistable lid assembly 106 and the base assembly, the friction material 710 allows the twistable lid assembly 106 to be continuously variable (i.e. no discrete positions) relative to the base assembly 101. Alternatively, in other embodiments the frictional material 710 may be disposed on the drive 604 and/or the barrel 606. By way of example and not limitation, suitable frictional materials may include rubber, silicone, combinations of the foregoing, or the like. The frictional material 710 may vary in size, shape, quantity, configuration, and placement.

In FIGS. 7A-7C, the retention mechanisms as illustrated may vary in quantity, size, orientation, configuration, and placement. For instance, the spring loaded pin 702 may be disposed on the barrel 606, the base assembly 101, or on the lid assembly 106 while the opening 704 may be disposed on the drive 604, the base assembly 101, or the lid assembly 106. In addition, the one or more shapes 706 may be disposed along any surface of the base assembly 101 to fixedly intermesh with the one or more complimentary shapes 708 on the twistable lid assembly 106. Alternatively, the one or more shapes 706 and the one or more complimentary shapes 708 may be disposed on an exterior surface of the drive 604 or the barrel 606. In some embodiments, more than one retention mechanism may be included concurrently. For example, the spring loaded pin 702 and the opening 704 may be used in combination with the one or more shapes 706 and the one or more complimentary shapes 708. In some examples, the retention mechanism may be configured to retain the lid assembly 106 in substantially any position (e.g., continuously variable) within the range of motion relative to the base assembly 101. In other examples, the lid assembly 106 may be retained in multiple discrete positions within the range of motion.

Figure 8:
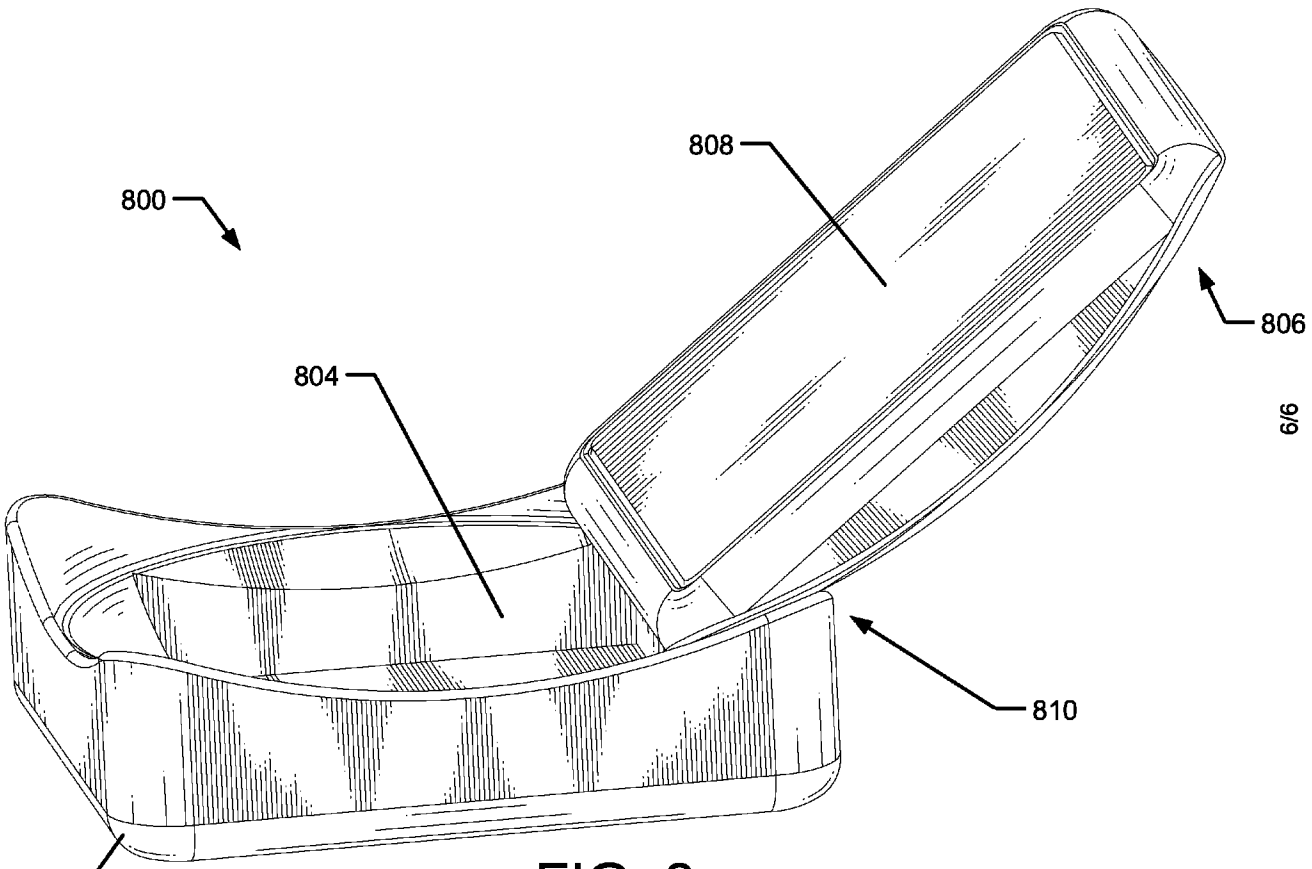
FIG. 8 depicts a perspective view of an additional example cosmetic compact with a twistable lid assembly in the open position.

FIG. 8 depicts a perspective view of an additional example cosmetic compact 800 with a twistable lid in the open position. The additional example cosmetic compact 800 includes a base assembly 802, an insert 804, a twistable lid assembly 806, and a mirror 808. While the base assembly 802 and the twistable lid assembly 804 are illustrated as having a substantially square shape, a variety of other shapes and types are contemplated. For example, the shape of the base assembly 802 and the twistable lid assembly 804 may be generally rectangular, ovoid, elliptical, or any other suitable shape.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, embodiments described herein having certain shapes, sizes, and configurations are merely illustrative. For this reason, the shapes, sizes, and configurations of the described embodiments may vary.

What is claimed is:

1. A cosmetic compact comprising:
- a base assembly;
- a lid assembly to cover the base assembly; and
- a hinge coupling the lid assembly to the base assembly enabling the lid assembly to spin relative to the base assembly, the hinge disposed in the perimeter of the base assembly and fixed at an oblique angle relative to a bottom surface of the base assembly, such that the lid assembly is spinnable about the hinge.

2. The cosmetic compact of claim 1, further comprising a pan for holding product, the base assembly at least partially encasing the pan.

3. A cosmetic compact comprising:
- a pan for holding a product;
- a base assembly comprising a base and an insert, the base at least partially encasing the insert and the insert at least partially encasing the pan;
- a twistable lid assembly coupled to the base assembly, the twistable lid assembly comprising:
  - a lid having an external surface and an internal surface; and
- a hinge linking the base assembly and the twistable lid assembly, the twistable lid assembly being pivotable about the hinge by at least about 180 degrees relative to the base assembly, the hinge disposed on an outer perimeter of the twistable lid assembly at an oblique angle relative to the external surface of the twistable lid assembly.

4. The cosmetic compact of claim 3, wherein the external surface of the twistable lid assembly opens to a predetermined angle relative to a bottom surface of the base assembly.

5. The cosmetic compact of claim 4, wherein the predetermined angle is between about 100 degrees and 170 degrees.

6. The cosmetic compact of claim 4, wherein the predetermined angle is about 120 degrees.

7. The cosmetic compact of claim 3, wherein the base assembly and the twistable lid assembly comprise acrylonitrile butadiene styrene (ABS), styrene acrylonitrile (SAN), and/or metal.

8. The cosmetic compact of claim 3, further comprising a retention mechanism to maintain the twistable lid assembly in the open or the closed position relative to the base assembly.

9. The cosmetic compact of claim 3, wherein the base assembly and the twistable lid assembly comprise polypropylene (PP).

10. A cosmetic compact comprising:

a pan for holding a product;

a base assembly at least partially encasing the pan;

a lid assembly rotatably coupled to the base assembly, the lid assembly comprising:

a lid;

a hinge configured to enable rotation of the lid assembly relative to the base assembly between:

a stowed position in which an external planar surface of the lid assembly is substantially parallel to a bottom surface of the base assembly; and a use position in which the lid assembly is twisted about the hinge to expose the pan, the used position being generated by twisting the lid assembly about an axis by about 180 degrees, the axis being fixed at an oblique angle relative to the bottom surface of the base assembly.

11. The cosmetic compact of claim 10, the external planar surface of the lid assembly changing by at most about 75 degrees relative to the bottom surface of the base assembly when changing between the stowed position and the used position.

12. A cosmetic compact comprising:

a base assembly;

a lid assembly;

a rotational mechanism coupling the lid assembly to the base assembly, the rotational mechanism allowing the lid assembly to twist about an axis of rotation that is fixed relative to the base assembly between:

a closed position in which a top surface of the lid assembly is substantially parallel to a bottom surface of the base assembly; and an open position in which the top surface of the lid assembly is inclined relative to the bottom surface of the base assembly by at least 15 and at most 75 degrees.

13. The cosmetic compact of claim 12, wherein the rotational mechanism includes a hinge.

14. The cosmetic compact of claim 13, wherein the hinge is a barrel hinge.

15. The cosmetic compact of claim 12, the cosmetic compact further comprising a retention mechanism to maintain the lid assembly in the open and/or closed position.

16. The cosmetic compact of claim 15, the retention mechanism comprising one or more shapes on the lid assembly configured to engage one or more complimentary shapes on the base assembly.

17. The cosmetic compact of claim 16, the one or more shapes on the lid assembly comprising one or more indents or protrusions to engage the one or more complimentary shapes on the base assembly.

18. The cosmetic compact of claim 15, the retention mechanism comprising a frictional material.

19. The cosmetic compact of claim 15, the retention mechanism comprising a magnetic retention mechanism.

20. The cosmetic compact of claim 15, the retention mechanism comprising an interference fit.

* * * * *